US008857446B2

(12) United States Patent
Wu

(10) Patent No.: US 8,857,446 B2
(45) Date of Patent: Oct. 14, 2014

(54) DISPOSABLE ATOMIZER OF ELECTRONIC CIGARETTE

(75) Inventor: Yangyang Wu, Shenzhen (CN)

(73) Assignee: Shenzhen Smaco Technology Ltd., Shenzhen, Guangdong Province (CN)

( * ) Notice: Subject to any disclaimer, the term of this patent is extended or adjusted under 35 U.S.C. 154(b) by 705 days.

(21) Appl. No.: 13/176,036

(22) Filed: Jul. 5, 2011

(65) Prior Publication Data

US 2012/0145169 A1 Jun. 14, 2012

(30) Foreign Application Priority Data

Dec. 9, 2010 (CN) ..... 2010 2 0650584 U

(51) Int. Cl.
*A24F 47/00* (2006.01)
*A61M 15/06* (2006.01)

(52) U.S. Cl.
CPC ..... *A24F 47/008* (2013.01)
USPC ..... 131/273; 131/329; 128/202.21

(58) Field of Classification Search
CPC ..... A24F 47/002; A24F 47/008; A61M 15/06
USPC ..... 131/273, 329; 128/202.21
See application file for complete search history.

(56) References Cited

U.S. PATENT DOCUMENTS

2011/0011396 A1* 1/2011 Fang ..... 128/202.21
2011/0303231 A1* 12/2011 Li et al. ..... 131/329

* cited by examiner

*Primary Examiner* — Anthony Calandra
(74) *Attorney, Agent, or Firm* — Cheng-Ju Chiang

(57) ABSTRACT

The invention discloses a disposable atomizer of an electronic cigarette, comprising a battery component and an atomizer, wherein the atomizer comprises an atomizer cover, a rubber sleeve, an atomizer sleeve, a tobacco tar cotton, two wires, a heating wire, a rubber pad, a threaded sleeve, a propping pin, a first fiber pipe, a tar guide rope and a second fiber pipe; the heating wire is connected with one ends of both wires, and each of the other ends of the wires is fixedly connected with the propping pin; the heating wire and the tar guide rope are wound around together; the first fiber pipe is arranged in the tar guide rope, the second fiber pipe and the first fiber pipe are coaxially arranged, and the second fiber pipe is positioned behind the first fiber pipe; both the tar guide rope and the second fiber pipe are arranged in the tobacco tar cotton, and both the tobacco tar cotton and the threaded sleeve are arranged in the atomizer sleeve; the atomizer cover is arranged at the tail end of the atomizer sleeve; and the rubber sleeve is arranged in the atomizer sleeve and positioned between the second fiber pipe and the atomizer cover. So that the disposable atomizer of an electronic cigarette has the advantages of simple production process, high production efficiency and low labor cost.

4 Claims, 2 Drawing Sheets

DISPOSABLE ATOMIZER OF ELECTRONIC CIGARETTE

FIELD OF THE INVENTION

The invention relates to an electronic cigarette, in particular to a disposable atomizer of an electronic cigarette.

BACKGROUND ART

It's well known that smoking is harmful to one's health, but generally few of smokers can quit smoking as they have cigarette dependence and difficultly give it up. In view of this, an electronic cigarette is popular on markets, and is healthy for smokers and has no harm, and smokers can get the feeling of smoking, thereby being beneficial for quitting of smoking. But this product generally has the following disadvantages: inconvenient assembly, insufficient smoke amount, poor flowability of tobacco liquid, obvious bad smells produced during smoking, low efficiency and high labor cost.

CONTENT OF THE INVENTION

The invention aims at providing a disposable atomizer which can overcome the defects of the prior art, has simple structure, and can produce large amount of smoke after powered on by full contact of a tobacco tar cotton with a tar guide rope.

For achieving above purposes, the invention adopts the following technical scheme: a disposable atomizer of an electronic cigarette comprises a battery component and an atomizer, wherein the atomizer comprises an atomizer cover, a rubber sleeve, an atomizer sleeve, a tobacco tar cotton, two wires, a heating wire, a rubber pad, a threaded sleeve, a propping pin, a first fibre pipe, a tar guide rope and a second fibre pipe; the heating wire is connected with one ends of both wires, and each of the other ends of the wires is fixedly connected with the propping pin; the heating wire and the tar guide rope are wound around together; the first fibre pipe is arranged in the tar guide rope, the second fibre pipe and the first fibre pipe are coaxially arranged, and the second fibre pipe is positioned behind the first fibre pipe; both the tar guide rope and the second fibre pipe are arranged in the tobacco tar cotton, and both the tobacco tar cotton and the threaded sleeve are arranged in the atomizer sleeve; the atomizer cover is arranged at the tail end of the atomizer sleeve; and the rubber sleeve is arranged in the atomizer sleeve, and is positioned between the second fibre pipe and the atomizer cover.

Preferably, the tar guide rope is wound into the U shape.

Preferably, the rubber sleeve is a silicone sleeve, and the rubber pad is a silicone pad.

Preferably, the silicone pad is arranged outside the propping pin, and is positioned inside the threaded sleeve.

Preferably, each of two ends of the tar guide rope contacts with the tobacco tar cotton.

Preferably, the propping pin is arranged at one end of the threaded sleeve, and extends into the first fibre pipe.

The invention has the advantages that as the tar guide rope can fully contact with the tobacco barrel, more tar can produce more smoke when the atomizer is powered on by the battery to produce certain amount of heat, and simultaneously, the tar guide speed of the tar guide rope can guarantee the supply of sufficient tobacco tar so that the temperature will not be too high, and overhigh temperature can result in decomposition of tobacco tar and production of bad smells; and secondarily, the assembly is simple, and assembling two components of the electronic cigarette (which are a heating component and a positive electrode and negative electrode pin copper part component) with the insulating pipes (i.e. the first fibre pipe and the second fibre pipe) and the tar guide cotton along with the atomizer sleeve can finish the assembly. So that the invention has simple production process, high production efficiency and labor cost.

DESCRIPTION OF DETAILED EMBODIMENTS

Figure 1:
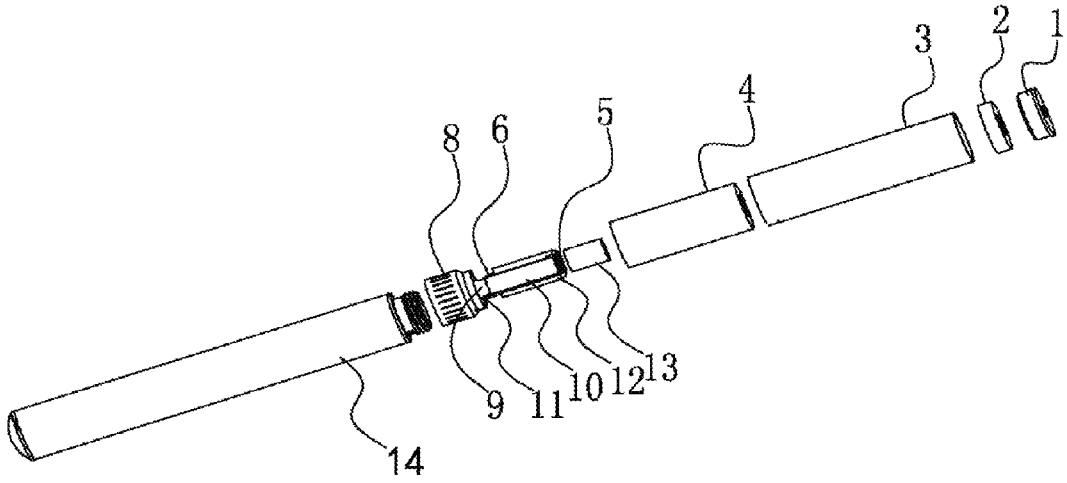
FIG. 1 is a breakdown drawing of the invention.
Figure 2:
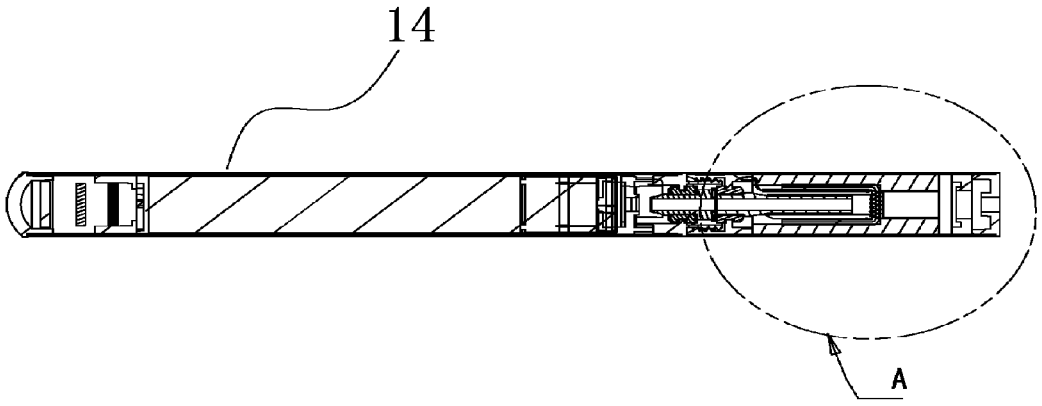
FIG. 2 is a sectional drawing of the utility mode.
Figure 3:
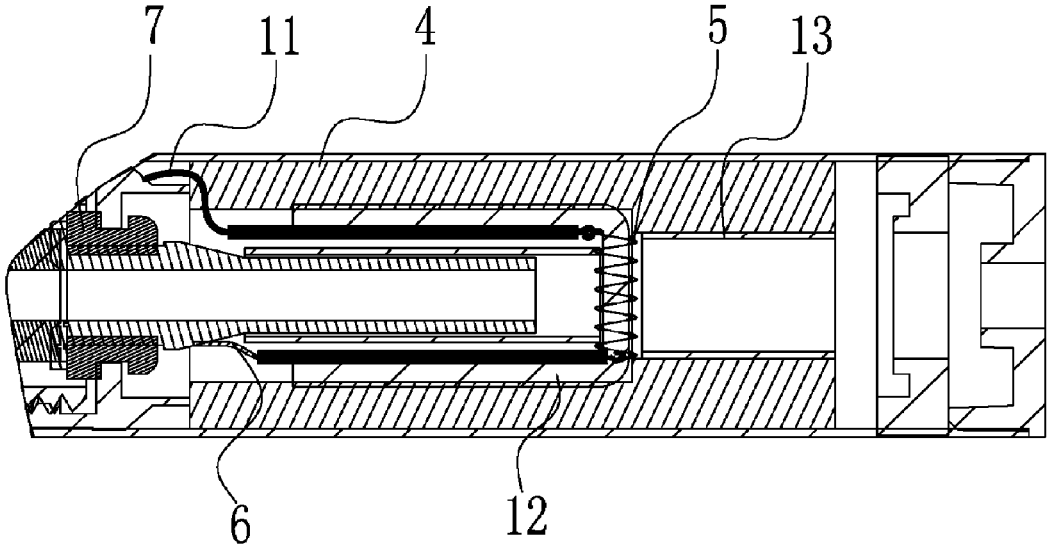
FIG. 3 is a partial enlarged drawing of A of FIG. 2.

For enabling those skilled in the art to better comprehend the invention, the invention is elaborated as follows by combining the drawings:

Refer to FIGS. 1-3. A disposable atomizer of an electronic cigarette comprises a battery component 14 and an atomizer, the atomizer comprises an atomizer cover 1, a rubber sleeve 2, an atomizer sleeve 3, a cotton 4, two wires 6 and 11, a heating wire 5, a rubber pad 7, a threaded sleeve 8, a propping pin 9, a first fibre pipe 10, a hollow fiber 12 and a second fibre pipe 13.

The heating wire 5 is connected at one end of each of the two wires 6 and 11, the other end of the wire 6 is fixedly connected with the propping pin 9, and the other end of the wire 11 is fixedly connected with the threaded sleeve 8; the heating wire 5 and the hollow fiber 12 are wound around together; the first fibre pipe 10 is arranged in the hollow fiber 12, the second fibre pipe 13 and the first fibre pipe 10 are coaxially arranged, and the second fibre pipe 13 is positioned behind the first fibre pipe 10; the hollow fiber 12 and the second fibre pipe 13 are both arranged in the cotton 4; the cotton 4 and the threaded sleeve 8 are both arranged in the atomizer sleeve 3; the atomizer cover 1 is arranged at a tail end of the atomizer sleeve 3; and the rubber sleeve 2 is arranged in the atomizer sleeve 3 and positioned between the second fibre pipe 13 and the atomizer cover 1.

The hollow fiber 12 is wound into a U shape, and the heating wire 5 is wound on a bottom part of the hollow fiber 12.

The rubber sleeve 2 is a silicone sleeve, and the rubber pad 7 is a silicone pad.

The rubber pad 7 is arranged outside the propping pin, and is positioned inside the threaded sleeve 8.

Each of two ends of the hollow fiber 12 contacts with the cotton 4.

The propping pin 9 is arranged at one end of the threaded sleeve 8, and extends into the first fibre pipe 10.

The manufacturing process of the invention is elaborated as follows:

1. The heating wire 5 is welded with the connection bending circular positions of the wires 6 and 11 using a soldering iron, respectively;
2. The heating wire 5 is wound on the hollow fiber 12;
3. The wire 6 is welded on an edge of the propping pin 9 using the soldering iron, and the wire 11 is welded on an edge of the threaded sleeve 8 using the soldering iron;
4. the propping pin 9 is wrapped using the cotton 4, and simultaneously, the first fibre pipe 11 and the second fibre pipe 13 are wrapped inside the cotton 4 when the cotton 4 wraps the propping pin 9 for a circle, and the screw rod with the cotton 4 arranged is mounted in the atomizer sleeve 3;

5. The threaded sleeve is pressed into the atomizer sleeve using a die cutting machine;
6. Tar is injected into the surface of the cotton 4 via a needle head of an injector after the injector is filled with tar; and
7. The rubber sleeve with a groove is parallelly mounted in the atomizer sleeve 3, and the atomizer cover 1 is pressed into the atomizer sleeve 3 using a punch.

What is claimed is:

1. A disposable atomizer of an electronic cigarette, comprising a battery component and an atomizer comprising an atomizer cover, a rubber sleeve, an atomizer sleeve, a cotton, two wires, a heating wire, a rubber pad, a threaded sleeve, a propping pin, a first fibre pipe, a hollow fiber, and a second fibre pipe, wherein the heating wire is connected at one end of each of the two wires, the other end of one of the two wires is fixedly connected with the propping pin, and the other end of the other of the two wires is fixedly connected with the threaded sleeve; the heating wire and the hollow fiber are wound around together; the first fibre pipe is arranged in the hollow fiber, the second fibre pipe and the first fibre pipe are coaxially arranged, and the second fibre pipe is positioned behind the first fibre pipe; both the hollow fiber and the second fibre pipe are arranged in the cotton, and both the cotton and the threaded sleeve are arranged in the atomizer sleeve; the atomizer cover is arranged at a tail end of the atomizer sleeve; and the rubber sleeve is arranged in the atomizer sleeve and positioned between the second fibre pipe and the atomizer cover;

Wherein the rubber sleeve is a silicone sleeve, and the rubber pad is a silicone pad, wherein the silicone pad is arranged outside the propping pin, and is positioned inside the threaded sleeve.

2. The disposable atomizer of an electronic cigarette according to claim 1, the hollow fiber is wound into a U shape.

3. The disposable atomizer of an electronic cigarette according to claim 1, wherein each of two ends of the hollow fiber contacts with the cotton.

4. The disposable atomizer of an electronic cigarette according to claim 1, wherein the propping pin is arranged at one end of the threaded sleeve, and extends into the first fibre pipe.

* * * * *